US005573014A

United States Patent [19]

Ginter

[11] Patent Number: 5,573,014

[45] Date of Patent: Nov. 12, 1996

[54] COMPLETE (BED-TIME) BACK SUPPORT SYSTEM

[76] Inventor: Ronald L. Ginter, 1817 Sheltering Tree, West Carrollton, Ohio 45449

[21] Appl. No.: 356,155

[22] Filed: Dec. 15, 1994

Related U.S. Application Data

[63] Continuation-in-part of Ser. No. 79,403, Jun. 21, 1993, abandoned.

[51] Int. Cl.[6] ..... A61G 15/00

[52] U.S. Cl. ..... 128/845; 5/632; 128/882

[58] Field of Search ..... 128/845, 846, 128/869, 876; 5/630, 631, 633, 648, 632, 650; 446/374

[56] References Cited

U.S. PATENT DOCUMENTS

| | | | |
|---|---|---|---|
| D. 177,472 | 4/1956 | Huntington | D3/9 |
| D. 251,985 | 5/1979 | Martin | D24/64 |
| 1,386,652 | 8/1921 | Patton . | |
| 2,250,267 | 7/1941 | Lins | 128/845 |
| 2,392,024 | 1/1946 | Couri | 446/374 |
| 2,933,738 | 4/1960 | Whelan | 5/338 |
| 3,283,346 | 11/1966 | Marsh | 5/481 |
| 3,604,023 | 9/1971 | Lynch | 5/327 |
| 3,648,308 | 3/1972 | Greenawalt | 5/632 |
| 4,173,048 | 11/1979 | Varaney | 5/632 |
| 4,574,412 | 3/1986 | Smith | 5/632 |
| 4,624,021 | 11/1986 | Hofstetter | 5/632 |
| 4,754,510 | 7/1988 | King | 5/431 |
| 4,790,042 | 12/1988 | Reich | 5/630 |
| 4,796,315 | 1/1989 | Crew | 5/431 |
| 4,901,384 | 2/1990 | Eary | 5/632 |
| 4,910,818 | 3/1990 | Grabill et al. | 5/443 |
| 5,117,522 | 6/1992 | Everett | 5/648 |
| 5,199,124 | 4/1993 | Klemis | 128/846 |
| 5,269,322 | 12/1993 | Mandel | 128/845 |

*Primary Examiner*—Michael A. Brown
*Attorney, Agent, or Firm*—Biebel & French

[57] ABSTRACT

A complete (bed-time) back support system is disclosed that, while at rest in a horizontal position in combination with any flat surface, positions the spine of the user to a straight alignment, hence, relieving pressure of the lumbar region, and helps to maintain the alignment whether said user is lying in either a supine or a lateral decubitus position. In a preferred form, the system comprises a cushion having an elongated portion with a sufficient length to extend from the chest of said user to just below the knees of said user and a knee support joining the tube with a sufficient extension to extend from the outside point of one knee to the outside point of the second knee of said user. In a particularly preferred form, the elongated member is adapted to restrict the user from lying directly prone as well as to provide support while the user is in a lateral decubitus position, hence forcing a straight spine alignment.

8 Claims, 5 Drawing Sheets

COMPLETE (BED-TIME) BACK SUPPORT SYSTEM

CROSS-REFERENCE TO RELATED APPLICATIONS

This is a continuation-in-Part of U.S. patent application Ser. No. 08/079,403, filed Jun. 21, 1993, now abandoned.

BACKGROUND OF THE INVENTION

1. Field of the Invention

This invention closely relates to orthopedic back braces, specifically those used for complete back support, however, though it serves to support the back during rest or sleep it is unlike any "back brace" known. In a mild way this invention relates to a common pillow.

2. Description of the Related Art

Heretofore, orthopedic back braces serve their purpose during the day, keeping the back of the active user supported during daily activities. This instrument, however, is very uncomfortable and impractical to use for support at bed-time, and in most cases is not recommended. Also, the use of everyday pillows is recommended by physicians and chiropractors alike, to be used at bed-time placed either under the knees (for support while lying on the back) or between the legs (for support while lying on either side). The drawbacks to the use of everyday pillows include waking up in the night to search for and replace the pillow for support as the user repositions during the course of sleep. Also, common pillows lose their shape and form decreasing their ability to provide support.

SUMMARY OF THE INVENTION

Accordingly, several objects and advantages of my invention include a support cushion that maintains its shape during use. It is uniquely designed so that it provides support to the spine whether the user chooses to lie on their back or either side. In a preferred embodiment, the cushion comprises an elongated tube portion terminating in a T-part knee support such that the elongated tube and T-part knee support define transversely-oriented cross-sections having substantially equal circumferences. The preferred cushion prohibits the user to lie directly on the user's stomach (although some people find this to be a comfortable position, according to most physicians, it happens to be very hard on the back). An adjustable belt fits comfortably around the user's waist allowing the support cushion to move freely with the user as the user chooses to reposition from side to back or back to either side without awakening and searching for the cushion as would be required with an ordinary pillow. An adjustable lumbar support, preferably comprising an oval cushion, is attached to the adjustable belt and provides additional support to the user while the user is lying on the user's back. The use of this Complete (Bed-Time) Back Support System provides the user with complete support and proper back alignment which assists the user in obtaining quality sleep, possibly pain-free.

REFERENCE NUMERALS IN DRAWINGS

1. Complete (Bed-Time) Back Support System
2. Cushion
3. Hidden Zipper
4. Carrying Handle
5. Adjustable Belt
6. Adjustable Lumbar Support Pad
7. Overlapping Belt Tip
8. Flap in Casing for Coupling Adjustable Belt
9. Special Concave Design
10. T-Part Knee Support Portion
11. Elongated Portion
12. Belt Stub
13. Hook and Loop Fastener for Adjustable Belt
14. Core
15. Casing
16. Transverse Portions
17. Hook and Loop Fastener for Adjustable Lumbar Support Pad
18. Inner Core
19. Outer Core

DETAILED DESCRIPTION OF THE PREFERRED EMBODIMENT

Figure 1:
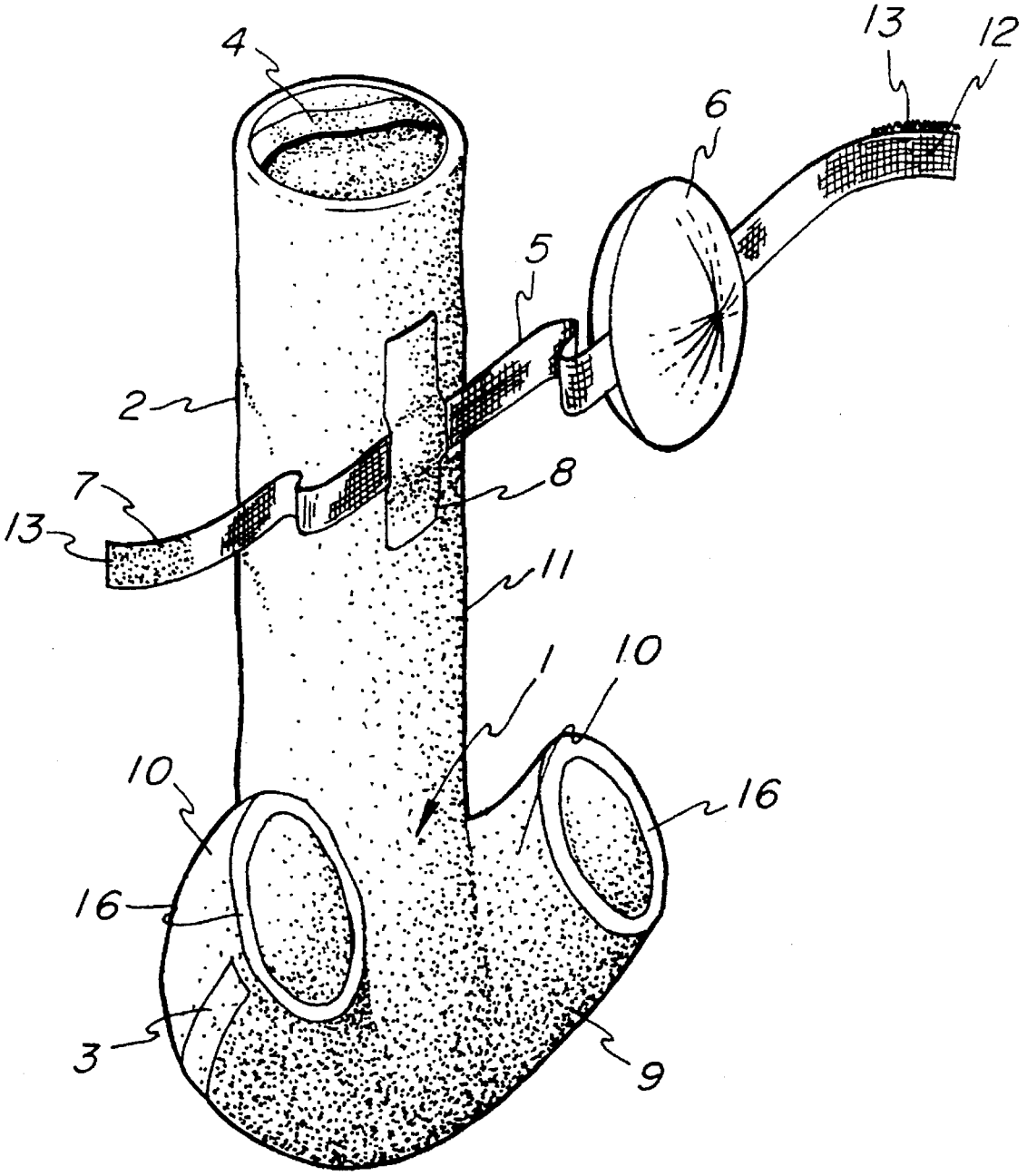
FIG. 1 shows a perspective view of a preferred embodiment of my invention, revealing the unit as a cylinder, T-shaped, more appropriately an anchor shaped (when viewed by the user) back support cushion.
Figure 5:
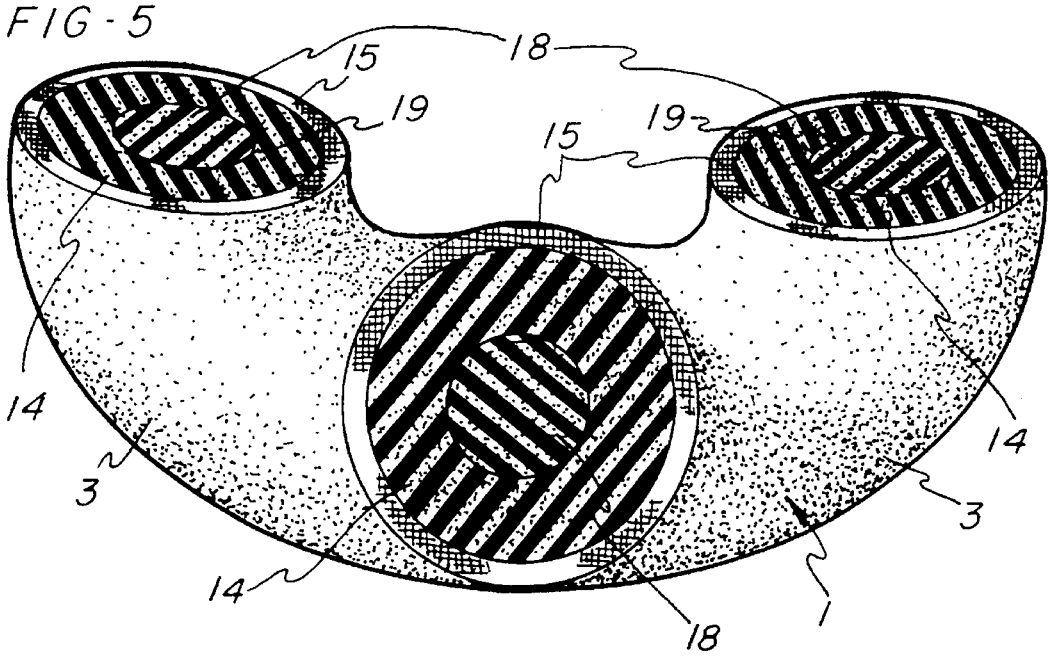
FIG. 5 shows a top sectional view of the back support cushion of FIG. 1 with the elongated portion and transverse projections sectioned to show the casing, inner core and outer core.
Figure 6:
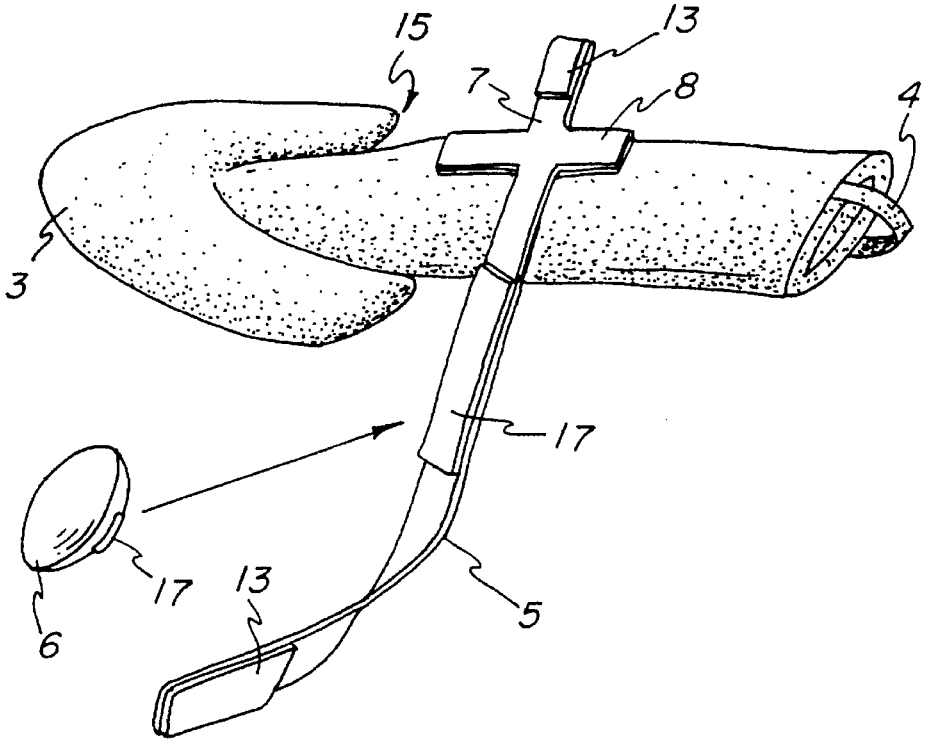
FIG. 6 shows a schematic view of an outermost cloth material or shell for the back support cushion of FIG. 1 in a collapsible form without a core for support.

FIG. 1 shows a perspective a of a preferred embodiment of my Complete (Bed-Time) Back Support System 1, which comprises a cushion 2. The preferred cushion 2 is T-shaped or, more appropriately, anchor-shaped defining an elongated portion 11, preferably a long cylindrical tube, and a T-part knee support portion 10 at the top of the "T" (or the bottom of the "anchor"). The T-part knee support portion 10 includes two transverse portions 16 defining which preferably define perimeters (e.g., circumferences) each generally equal to a perimeter (e.g., circumference) defined by the elongated portion 11. The cushion 2 comprises a core 14 (FIG. 5) and a casing or shell 15 (FIGS. 5 and 6). The core 14 is preferably composed of an inner core 18 and an outer core 19, each being made of foam rubber. The inner core 18 has a greater density, and is less compressible, than the outer core 19 so that the cushion 2 maintains its shape during use while also allowing for a small amount of flexibility to provide for proper circulation. The casing 15 is preferably formed from a hand-washable fabric and includes a hidden zipper 3 covering the length at the top of the "T" (or, equivalently, the length of the bottom of the "anchor"). The casing 15 also includes a carrying handle 4 at the opposite end to assist the user in keeping the system in place.

In a particularly preferred form, the System 1 also includes an adjustable belt 5 which allows the user to consciously or subconsciously reposition from side to back or back to either side without awakening, the whole time maintaining proper back alignment. An adjustable lumbar support 6, preferably in the form of an oval pad, is attached as by hook and loop material 17 (FIG. 6) to the adjustable belt 5 to provide additional support to the user while the user is lying on the user's back. An overlapping belt tip 7 is provided for attachment to a belt stub 12 by means of hook and loop material 13 to hold the System 1 in place. A flap 8 is provided in the casing 15 for coupling the adjustable belt 5 to the cushion 2. The flap 8 may be either integral with the remainder of the cushion at both ends (FIG. 2) or detachably coupled to the casing 15 by means such as hook and loop fastening material (not shown) to permit release the adjustable belt 5.

The T-part knee support portion 10 of the cushion 2 is designed to fit comfortably under the user's knees to provide support while the user is positioned on the user's back. The elongated portion 11 of the cushion 2 projects upward between the legs and rests on the abdomen of the user while the user is lying on the user's back. When lying on either side the elongated portion 11 supports the upper torso of the user (keeping the spine properly aligned), restricting the user from lying directly on the user's stomach.

Figure 2:
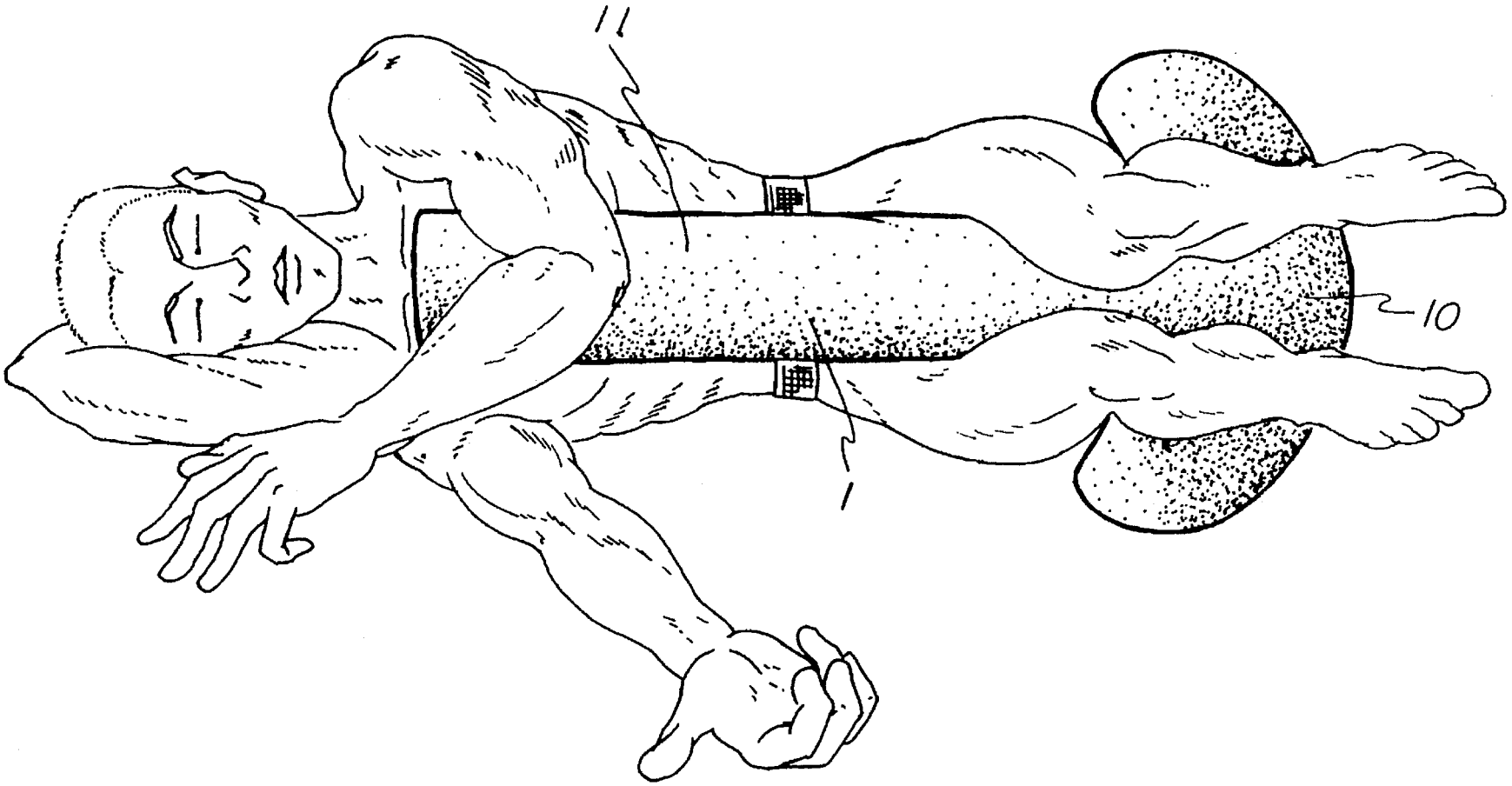
FIG. 2 shows a side elevational view while the user lies on the right side with the back support cushion of FIG. 1 in use.

FIG. 2 shows a side elevational view from the front of the user while the System 1 is in use. Notice how the elongated portion 11 remains positioned between the legs taking pressure off of the lower spine.

Figure 3:
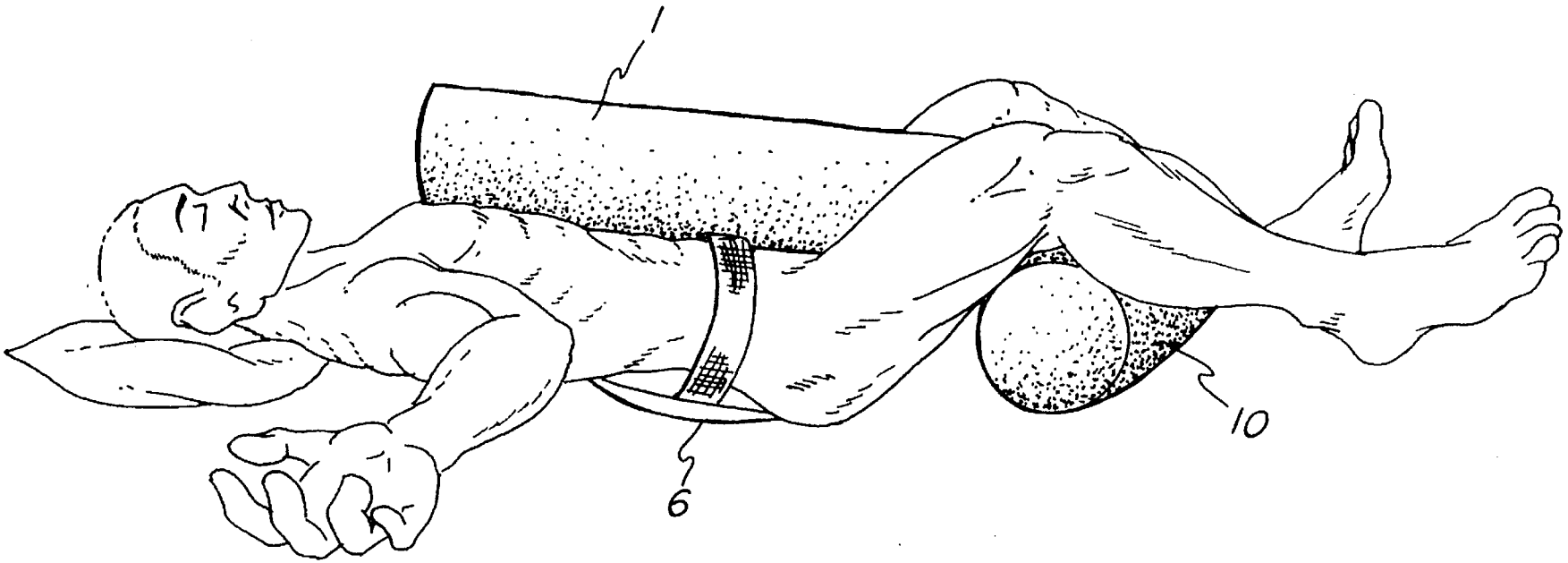
FIG. 3 shows a side elevational view of the back support cushion of FIG. 1 while in use as the user lies on the back resting both legs on the top of the T for support.

FIG. 3 shows a side elevational view of the System 1 in use as the user lies flat on the user's back resting both legs on the T-part knee support portion 10 for support. This position relieves a great deal of stress off of the lower back. Notice how the lumbar support 6 fills in the "hollow" of the lower back. This concept in conjunction with the T-part knee support portion 10 provides complete support while in this position.

Figure 4:
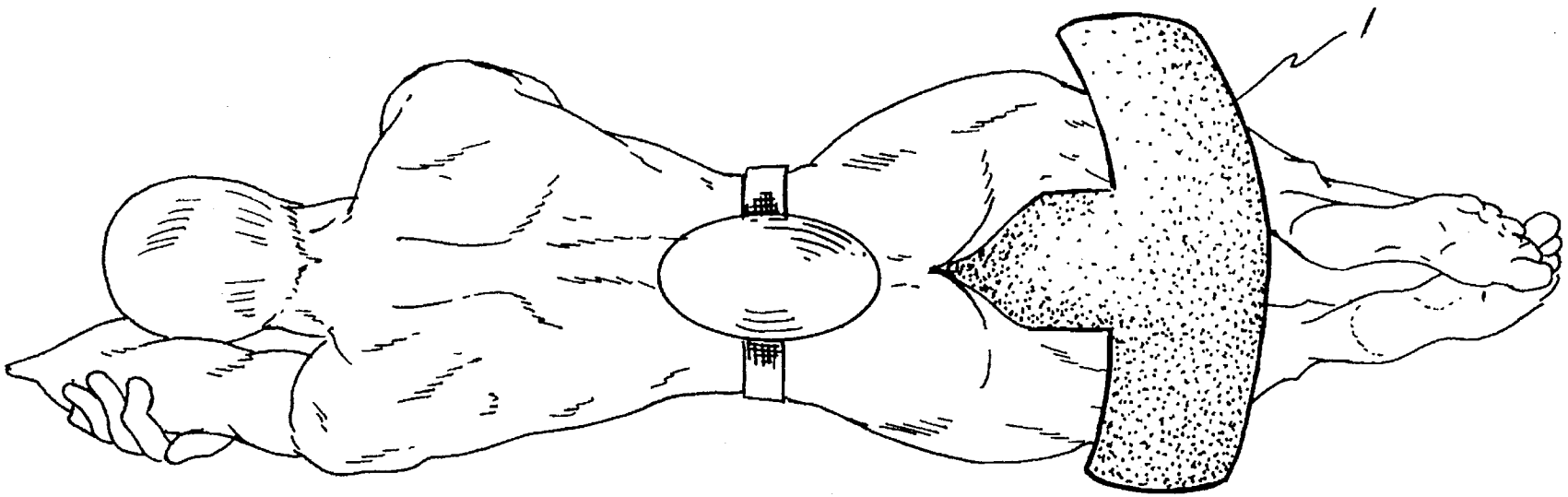
FIG. 4 shows a side elevational view from behind as the user lies on the left side while the back support cushion of FIG. 1 is in use (note how the spine alignment is straight)

FIG. 4 shows a side elevational view of the user from behind while the System 1 is in use. This is perhaps the most important view revealing how perfectly straight the entire spine is aligned. This position may be the most comfortable for those persons who suffer with lower back pain and discomfort.

The System 1 becomes useful when the T-part knee support portion 10 is placed underneath the user's knees. This position takes the pressure off of the lower spine while the user lies on the user's back. The adjustable lumbar support 6 is placed in the lumbar (lower back) region of the spine. This allows additional support to the lumbar as the user lies on the user's back. The elongated portion 11 protrudes up between the legs and gently across the abdomen. The adjustable belt 5 slips around the waist and reattaches with the overlapping belt tip 7 where it originated, belt stub 12. The elongated portion 11 then stays in place allowing the user to rotate to either side maintaining support between the legs.

The elongated portion also serves to prevent the user from lying completely on the user's stomach. Whichever position the user attempts to rest or sleep in, total back support is provided by the System 1. The light-weight construction of the System 1 accompanied with the carrying handle 4 makes the System 1 accessible for almost anyone at any age to use.

Thus, the reader will see that the Complete (Bed-Time) Back Support System 1 provides such persons who suffer lower back pain and discomfort the much needed relief, proper support and alignment of the spine during such time the user lies down to rest or sleep, while on their back or either side. This System 1 prevents such persons from lying completely on their stomachs which could create additional discomfort. The benefit of such a System 1 allows users to reposition freely and as frequently as needed without awakening and having to go through the trouble of searching and replacing a support pillow. Bad backs are not usually of one's choice, but rather a weakness or disability. The use of the System 1 restores one's ability to sleep, possibly pain-free.

Various changes or modifications in the invention described may occur to those skilled in the art without departing from the true spirit or scope of the invention. In one such modification, the core 14 includes a flexible aluminum rod, shaped as a "T" and located in the very center of the durable foam-rubber. This modification may prolong the durability of the core 14. Furthermore, the cushion 2 may be offered in small, medium, and large or perhaps tall and short.

Other variations include the use of different materials for manufacturing the System 1. The core 14, for example, could be made of a hollow plastic with foam-rubber of substitute shell. The casing 15 might also be made of polyester or mixed cotton with another material. The type of lumbar support could be varied as is well known in the art. In addition, the System 1 may be manufactured in a "traveling model" consisting of a plastic blow-up version of the original. The above description of preferred embodiments of the invention is intended to be illustrative and not limiting, and it is not intended that the invention be restricted thereto but that it be limited only by the true spirit and scope of the appended claims.

What is claimed is:

1. A complete back support system that, while at rest in a horizontal position in combination with any flat surface, positions the spine of the user to a straight alignment, hence, relieving pressure of the lumbar region, and helps to maintain said alignment whether said user is lying in either a supine or a lateral decubitus position, comprising:

a cushion, said cushion having an elongated portion with a sufficient length to extend from the chest of said user to just below the knees of said user and defining first circumference transverse to said length, and a knee support joining said elongated portion with a sufficient extension to extend from approximately the outside point of one knee to approximately the outside point of the second knee of said user and defining a second circumference transverse to said extension, said second circumference being equal to said first circumference;

said elongated portion being adapted to restrict said user from lying directly prone as well as to provide support while said user is in a lateral decubitus position, hence forcing a straight spine alignment;

wherein said cushion includes a first foam rubber material at least substantially surrounding a second foam rubber material less compressible than the first foam rubber material to provide durability combined with comfort and to allow for blood circulation of the user.

2. A complete back support system that, while at rest in a horizontal position in combination with any flat surface, positions the spine of the user to a straight alignment, hence, relieving pressure of the lumbar region, and helps to maintain said alignment whether said user is lying in either a supine or a lateral decubitus position, comprising:

a cushion, said cushion having an elongated portion with a sufficient length to extend from the chest of said user to just below the knees of said user and defining a first circumference transverse to said length, and a knee support joining said elongated portion with a sufficient extension to extend from the outside point of one knee to the outside point of the second knee of said user and defining a second circumference transverse to said extension, said second circumference being equal to said first circumference;

said elongated portion being adapted to restrict said user from lying directly prone as well as to provide support while said user is in a lateral decubitus position, hence forcing a straight spine alignment;

said cushion including a casing which encloses said cushion, an adjustable belt with an adjustable lumbar support attached to said casing, and a carrying handle;

said adjustable belt including hook and loop material to adjust for both height and breadth of said user; and said lumbar support including a pad made with a foam material to be of sufficient size to cover a lumbar region of a spine of said user for adjustment along said adjustable belt with the use of additional hook and loop material to provide a means of support to the lumbar region of the spine in combination with the knee support behind the knees of said user while lying supine.

3. A cushion comprising an elongated portion terminating in a knee support, said elongated portion defining an elongated portion circumference, and said knee support having transverse portions each extending transversely to said elongated portion and each defining knee support portion circumferences substantially equal to the elongated portion circumference.

4. The cushion as recited in claim 3 wherein said elongated portion and said knee support are constructed and arranged such that said cushion is anchor-shaped.

5. The cushion as recited in claim 3 wherein said elongated portion includes a first foam rubber material at least substantially surrounding a second foam rubber material less compressible than the first foam rubber material to allow for blood circulation in the user.

6. A cushion comprising an elongated portion terminating in a knee support, said elongated portion defining an elongated portion circumference, and said knee support having transverse portions each extending transversely to said elongated portion and each defining knee support portion circumferences substantially equal to the elongated portion circumference;

said cushion including a casing which encloses said cushion, an adjustable belt coupled to said shell for engagement with the user, and an adjustable lumbar support pad coupled to said adjustable belt for supporting a lumbar of the user.

7. The cushion as recited in claim 6 wherein said adjustable belt includes hook and loop material to facilitate adjustment of said adjustable belt for both the height and breadth of the user.

8. A complete back support system comprising a cushion having a core having a resilient inner core and a resilient outer core surrounding said inner core, said outer core being more compressible than said inner core, wherein said inner and outer cores each comprise foam rubber compositions.

* * * * *

UNITED STATES PATENT AND TRADEMARK OFFICE

CERTIFICATE OF CORRECTION

PATENT NO. : 5,573,014

DATED : November 12, 1996

INVENTOR(S) : Ronald L. Ginter

It is certified that error appears in the above-indentified patent and that said Letters Patent is hereby corrected as shown below:

Column 4, line 44, the word "a" has been omitted after the word "defining".

Column 6, line 20, "shell" should be "casing".

Signed and Sealed this

Twenty-eighth Day of January, 1997

*Attest:*

Bruce Lehman

BRUCE LEHMAN

*Attesting Officer*

*Commissioner of Patents and Trademarks*